US005125586A

United States Patent [19]

Whitethorn

[11] Patent Number: 5,125,586

[45] Date of Patent: Jun. 30, 1992

[54] HOLDER FOR ROLL OF PAPER TOWELS

[76] Inventor: James H. Whitethorn, Box 94, Petersburg, Ak. 99833

[21] Appl. No.: 759,174

[22] Filed: Sep. 13, 1991

[51] Int. Cl.[5] ..... B65H 16/00

[52] U.S. Cl. ..... 242/55.2; 242/75.4; 248/309.1

[58] Field of Search ..... 248/309.1, 309.2, 205.1, 248/201; 242/55.2, 75.4

[56] References Cited

U.S. PATENT DOCUMENTS

| | | | |
|---|---|---|---|
| 1,105,951 | 8/1914 | Bagnall | 242/55.2 |
| 2,370,821 | 3/1945 | Stott | 242/55.2 |
| 2,419,798 | 4/1947 | Stone | 242/55.2 |
| 2,571,321 | 10/1951 | Wettley | 242/55.2 |
| 3,292,874 | 12/1966 | Tinkham | 242/55.2 |

*Primary Examiner*—David M. Purol
*Attorney, Agent, or Firm*—Robert W. Jenny

[57] ABSTRACT

The holder comprises a base attachable to a support surface, a sleeve/shaft assembly and structure interconnecting the base and sleeve/shaft assembly. In the sleeve/shaft assembly the sleeve is rotatable on the shaft and carries a roll of paper towels. The outer surface of the sleeve is contoured to prevent rotation of the core of the paper towel roll on the sleeve. The sleeve has a cylindrical inside surface. The shaft has a cylindrical portion and two diametrically opposed leaf springs are formed in the wall of the shaft and contoured such that the tapered portion of a plug threaded into the end of the shaft contacts the springs to adjust the forces of contact between the spring tips and the inside surface of the sleeve. Adjusting these forces adjusts the friction between the sleeve and shaft and thereby the tension required to roll towels off the roll by pulling on the end of the towels.

1 Claim, 1 Drawing Sheet

HOLDER FOR ROLL OF PAPER TOWELS

BACKGROUND OF THE INVENTION

1. Field

The subject invention is in the field of holders for products used in people's hands, such as holders for knives, utensils, tools and paper products. More specifically it is in the field of holders for paper products and, still more particularly, paper towels.

2. Prior Art

There is much prior art in this particular field, patented and not patented. The U.S. Patents Nos. listed below are a sample of the patented prior art:

| |
|---|
| 1,687,819 |
| 1,851,722 |
| 2,073,429 |
| 2,546,280 |
| 2,632,606 |
| 2,699,903 |
| 2,994,488 |
| 3,127,125 |
| 3,197,153 |
| 3,346,208 |
| 3,799,465 |
| 3,915,281 |
| 4,099,601 |
| 4,471,486 |
| 4,625,931 |

The holders used in butcher paper, wrapping paper and drafting paper and cloth constitute significant prior art since they comprise apparatus for keeping non dispensed paper from unrolling and apparatus tending to prevent the roll of paper from unrolling more material when a portion of material is being separated from the roll. One such apparatus commonly used comprises a blade having its long axis parallel to the axis of the roll, supported on a radial arm at each end of the blade with the blade resting on the surface of the roll and held there by the force of gravity. The weight of the blade is such that material can be parted and removed by tearing it along the blade without lifting the blade significantly off the roll. A key factor is the tearing strength of the material relative to the weight of the blade. The weight of the blade also presses it against the roll, providing a friction force which tends to prevent the roll from unrolling inadvertently.

This kind of apparatus can only be used with the roll axis horizontal and this is too restrictive to sales in current markets. Also selling price has a major influence on commercial success of paper holders in wide use and the cost of the blade type apparatus has been found to be prohibitive.

A significant advantage of the blade type apparatus is that the tension force required to unroll the material remains essentially constant and independent of the change in outside diameter of the roll of material as it is used up. In holders in which the tendency to unroll is inhibited by essentially constant friction forces applied near the axis of the roll, the tension force increases significantly as roll diameter decreases. This poses a problem, particularly with paper perforated to separate into sheets when the tension force is applied near either edge of the paper rather than at the center. A crucial compromise is required related to the tensile strength of the paper at the perforations. Strength suitable for the tension force needed to unroll the paper when the roll diameter is large is not suitable when the roll diameter has decreased, and vide verse. The force required to separate a towel from the roll also varies in different brands of paper towel.

This problem was addressed by Ancona et al in U.S. Pat. No. 4,741,486. Their apparatus comprises a tension bar 136 (lines 58–68, column 6 and lines 1–8 column 7) which "prevents undesirable pulling of additional sheets from roll 14 and also prevents the next sheet that is to be pulled from dangling freely." No mention is made of having the force applied to the roll by the tension bar vary such that the force needed to unroll paper is essentially constant and independent of roll diameter and it is considered not obvious from this patent to design the spring which moves the tension bar so that the tension needed to unroll paper is essentially constant. Also, the apparatus of Acuna et al is deemed to be such that it could not be marketed at a competitive price.

U.S. pat. Nos. 3,197,153 and 4,625,931 show rolls of sheet or strip material wound onto cores with the rotation of the cores frictionally restricted and with the frictional adjustable. Elastomeric drum 14 of the apparatus of U.S. Pat. No. 3,197,153 provides both friction of the core 10 on the drum and friction between the drum and the supporting mechanism. The apparatuses of these patents are considered to be too complicated and expensive to be commercially successful in paper towel holders and the like.

In consideration of the factors discussed above, a prime objective of the subject invention is provision of a holder for paper towels in which the tension required to unroll the towels is adjustable to compensate for effects of the diameter of the roll and characteristics of the material of the roll. A second objective is that the apparatus be simple enough to enable marketing the invention at a competitive price. A third objective is that the apparatus be usable with the roll vertical, horizontal or at any other angle.

SUMMARY OF THE INVENTION

The subject invention is a holder for rolls of transversely perforated strips such as paper towels. The holder comprises a base, a shaft, a structure between the base and the shaft and a sleeve. A roll of paper towels, for example, in installed on the sleeve by inserting the sleeve through the core of the roll of towels. The external surface of the sleeve is ribbed longitudinally to prevent rotation of the core and roll on the sleeve. The sleeve is then slid onto the shaft and rotatable on the shaft. These is adjustable mechanism which frictionally inhibits rotation of the sleeve on the shaft. Adjustment of this mechanism determines the amount of tension required to unroll towels by pulling on the end of the towels. The tension is set so that there is just enough resistance to unrolling to provide adequate reaction force to the force needed to tear off a towel from the roll. With too much tension unrolling a length of towel is difficult if not impossible without premature separation of towels or pieces of towels from the roll. With too little tension it may be necessary to hold the roll while tearing off a length of towel to provide the needed reaction force and prevent unrolling more towel than desired.

The shaft has a cylindrical portion and in internally threaded at its free end. The wall of the shaft is slit to provide two, diametrically opposite cantilever leaf springs with their long dimensions parallel to the axis of the shaft. The springs have outer surfaces and there are protrusions on the inner surfaces of the springs closest to the shaft, sloping away from the threaded end of the shaft and toward the axis. A threaded plug with a frustoconical, i.e. tapered, shape threads into the shaft with the tapered portion engaging the protrusions. When the plug is threaded further into the shaft the springs are forced away from the shaft axis and their ends press harder on the inner surface of the sleeve, increasing friction between the sleeve and the shaft. Backing the plug out decreases the forces and friction. Adjustment of the friction adjusts the tension required to unroll towels from the roll by pulling on the end of the towels.

The invention is described in more detail below with reference to the attached drawings.

DETAILED DESCRIPTION OF THE DRAWINGS

DETAILED DESCRIPTION OF THE INVENTION

Figure 1:
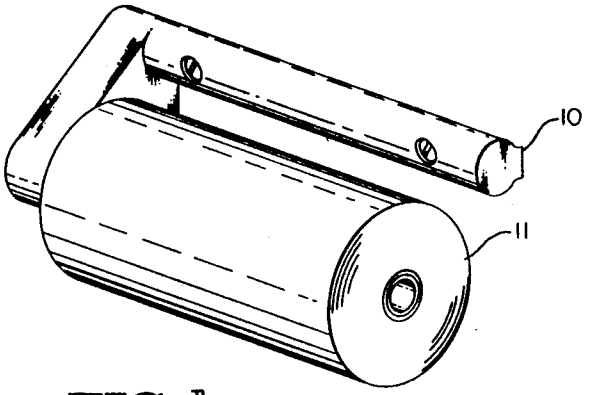
FIG. 1 is a perspective view of the subject invention with a roll of paper towels in place.
Figure 2:
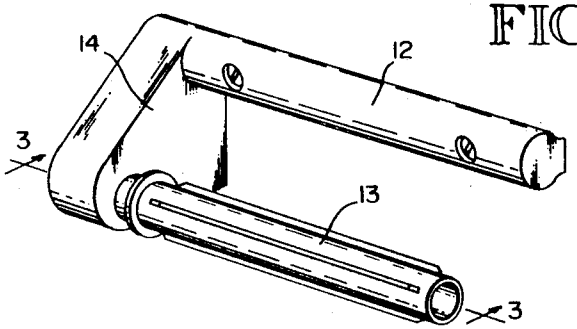
FIG. 2 is a perspective view of the subject invention with no towel roll in place.

The subject invention is a holder for a roll of transversely perforated paper strip such as a roll of paper towels. FIG. 1 is a perspective view of the holder 10 with a roll of paper towels 11 in place. FIG. 2 is a similar view but with no roll of towels in place. The holder comprises a base 12, a sleeve and shaft assembly 13 on which the roll of towels is installed and support structure 14 interconnecting the base and the sleeve/shaft assembly.

Figure 3:
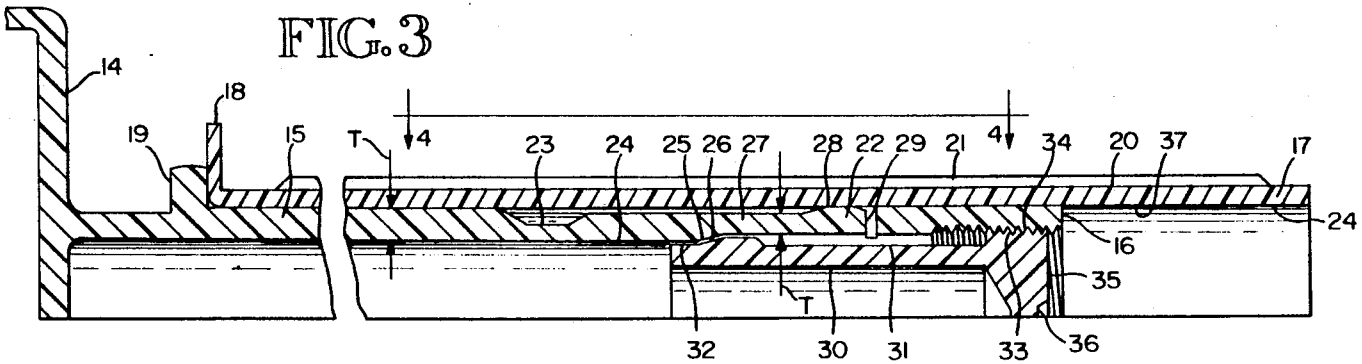
FIG. 3 is an enlarged and shortened sectional view taken at 3—3 in FIG. 2.

FIG. 3 is an enlarged and shortened sectional view of the sleeve/shaft assembly taken at 3—3 in FIG. 2. Shaft 15 extends from structure 14 and is cylindrical near its free end 16. Sleeve 17 telescoped onto the shaft with flange 18 on the sleeve resting against flange 19 on the shaft. The outer surface 20 of the sleeve is ribbed, rib 21 being typical. The ribs assure that the roll does not turn on the sleeve and that all rotation of the roll involves rotation of the sleeve on the shaft.

Figure 4:
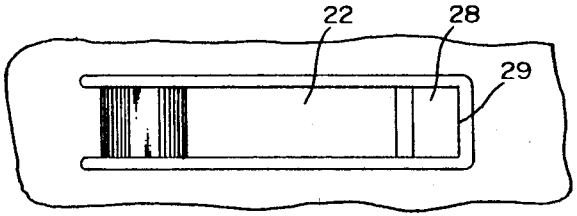
FIG. 4 is view of the shaft taken at 4—4 in FIG. 3.

Two diametrically opposite cantilever leaf springs are formed in the shaft, spring 22 being typical and shown in plan view in FIG. 4, a view of the shaft taken at 4—4 in FIG. 3. Referring to FIG. 3, each spring has a thin section 23 which serves as a hinge. The bore 24 of the shaft is tapered at 25 to provide a protrusion, preferably a ramp 26 on each spring on the side facing the axis of the shaft. Section 27 of each spring is thicker than section 23 but thinner than the wall thickness T of the shaft. This conformation provides a pad 28 at the free end 29 of each spring.

Plug 30 has a shank portion 31, a tapered (frustoconical) tip 32 and a threaded portion 33. The threaded portion engages the internal threads 34 in free and 16 of the shaft and tip 32 engages the ramps on the springs. End 35 of the plug has a screwdriver slot 36. Threading the plug into the shaft causes tip 32 to apply pressure to the protrusions, thereby increasing the forces applied by pads 28 against the internal surface 37 of the sleeve, thus increasing the friction between the shaft and sleeve. Threading the plug in the outward direction decreases the friction.

In use, the sleeve is removed from the shaft and inserted in the core of a roll of towels. The sleeve and towels are then installed on the shaft and plug 30 is adjusted such that the desired amount of tension is required to unroll towels by pulling on the end of the towels.

It is considered to be understandable from this description that the subject invention meets its objectives. The tension required to unroll towels is adjustable. The apparatus is simple enough to enable marketing it at a competitive price the holder is usable in any positional attitude.

It is also considered to be understood that, while one embodiment of the invention is described herein, other embodiments and modifications of the one described are possible within the scope of the invention which is limited only by the attached claims. For example, the interconnecting structure may be such that the shaft can be reoriented to allow installation and removal of towels where lengthwise space limitations would otherwise prevent such installation and removal. Also, the adjustment plug may extend beyond the end of the shaft to permit tension adjustment without using a screwdriver or similar implement.

I claim:

1. A holder for a roll of transversely perforated paper strips, said roll having a core, said holder being attachable to a support surface and comprising:

a base, a sleeve/shaft assembly and structure interconnecting said base and said sleeve/-shaft assembly, said base being attachable to said support surface to attach said holder to said surface, said sleeve/shaft assembly comprising:

a) a shaft which extends from said structure for interconnecting parallel to said base and has a shaft free end, said shaft being cylindrical at said free end and having a cylinder wall, an axis and internal threads at said free end, said shaft further comprising at least one cantilevered leaf spring formed in said cylinder wall, said at least one spring having a long dimension parallel to said axis and said spring free end disposed toward said shaft free end, said at least one spring having a protrusion on said surface facing said axis, b) an essentially cylindrical sleeve having a smooth inner surface and a ribbed outer surface, said sleeve fitting rotatably on said shaft and c) a plug having a threaded portion and a tapered portion such that with said threaded portion engaging said internal threads said tapered portion engages said protrusion on said at least one spring, said plug further comprising means for rotating said plug in said shaft, whereby with said sleeve installed on said shaft said plug can be rotated further into said shaft to cause said tapered portion to apply force to said protrusion to, in turn, force said free end of said at least one spring to contact said inner surface of said sleeve and whereby said force can be adjusted by rotating said plug in either direction to adjust said force on said protrusion.

* * * * *